US007921838B2

(12) United States Patent
Tippmann, Jr. et al.

(10) Patent No.: US 7,921,838 B2
(45) Date of Patent: Apr. 12, 2011

(54) COMBINATION NON-LETHAL PROJECTILE LAUNCHER AND FLASH LIGHT

(75) Inventors: Dennis J. Tippmann, Jr., Fort Wayne, IN (US); Bryce A. Carrico, Fort Wayne, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 0 days.

(21) Appl. No.: 12/792,381

(22) Filed: Jun. 2, 2010

(65) Prior Publication Data

US 2010/0252014 A1 Oct. 7, 2010

Related U.S. Application Data

(62) Division of application No. 11/348,915, filed on Feb. 7, 2006, now abandoned.

(51) Int. Cl.
*F41B 11/00* (2006.01)

(52) U.S. Cl. ..... 124/71; 124/74; 124/75

(58) Field of Classification Search ..... 124/71, 124/73, 74, 75, 76, 77
See application file for complete search history.

(56) References Cited

U.S. PATENT DOCUMENTS

| | | | | |
|---|---|---|---|---|
| 5,280,778 | A * | 1/1994 | Kotsiopoulos | 124/73 |
| 7,451,755 | B2 * | 11/2008 | Dobbins et al. | 124/71 |
| 7,770,572 | B2 * | 8/2010 | Lian | 124/74 |
| 2003/0047174 | A1 * | 3/2003 | Tiberius et al. | 124/74 |
| 2007/0151549 | A1 * | 7/2007 | Wood | 124/73 |
| 2010/0101550 | A1 * | 4/2010 | Carnall | 124/76 |

* cited by examiner

*Primary Examiner* — Troy Chambers
*Assistant Examiner* — Gabriel J Klein
(74) *Attorney, Agent, or Firm* — Barnes & Thornburg LLP

(57) ABSTRACT

An apparatus for firing a non-lethal projectile comprises a body with an internal cavity. A light source may be disposed in the cavity to illuminate an area outside the body. A firing mechanism may also be provided to cause a projectile to be propelled through the body.

9 Claims, 11 Drawing Sheets

COMBINATION NON-LETHAL PROJECTILE LAUNCHER AND FLASH LIGHT

RELATED APPLICATIONS

The present application is a divisional of U.S. patent application Ser. No. 11/348,915, filed on Feb. 7, 2006, entitled "Combination Non-Lethal Projectile Launcher and Flash Light," which is hereby incorporated by reference in its entirety.

TECHNICAL FIELD

This invention relates to a flash light with a projectile launching mechanism and particularly to a mechanism capable of launching non-lethal projectiles. The invention also relates to a valve arrangement for use with compressed gas guns.

BACKGROUND

Law enforcement personnel and security guards often carry immobilizing devices, such as pepper spray, tear gas or firearms. Individuals also employ these types of devices to protect against an attacker or aggressive animal. In dark conditions, it is desirable to carry a portable light, such as a flash light, to illuminate the surroundings. Since the simultaneous use of a flash light and immobilizing device requires both hands, this can become unmanageable when the user needs a free hand for another task.

Lighting devices that mount to lethal firearms are well known. These devices allow the use of a firearm and lighting device with a single hand. However, such devices are bulky when mounted to the firearm. Moreover, the lighting device must be separately carried when not mounted.

In many cases, law enforcement and other individuals use non-lethal guns, such as for crowd control. For example, marking guns (commonly known as paintball markers) typically use compressed gas to propel frangible projectiles. Typically, these projectiles are filled with a marking material and/or an immobilizing material, similar to pepper spray.

U.S. Pat. No. 6,742,512 to Ho et al. describes a paintball marker with a lighting device that mounts to the hopper of the marker. As with other mounting assemblies for lighting devices, the marker described in Ho et al. is bulky. For example, law enforcement personnel would be unable to holster the marker with the lighting device attached. Moreover, the mounting assembly would not be appropriate for non-lethal guns that do not have a hopper.

Therefore, there exists a need for a lighting device that is integral to an immobilizing device.

SUMMARY

An apparatus for firing non-lethal projectiles in accordance with one aspect of the invention comprises a grip portion defining a grip axis along a longitudinal axis of the grip portion. A front portion is provided that defines a bore therethrough. The bore defines a barrel axis along a longitudinal axis of the bore, such that the grip axis and the barrel axis are substantially parallel. The apparatus also includes a firing mechanism operable to cause a projectile to be propelled through the bore.

In some exemplary embodiments, the grip axis is aligned with the barrel axis. The grip portion may be constructed such that the grip portion has a smaller cross-sectional area than the front portion. Typically, the grip portion is generally cylindrical in shape. Embodiments are also contemplated in which the grip portion may have an oblong cross section.

In some exemplary embodiments, the firing mechanism may include a trigger. For example, the trigger may have a longitudinal axis that is approximately parallel to the barrel axis. In other embodiments, the trigger may be movable with respect to the front portion along an axis that is approximately perpendicular to the barrel axis. Typically, the trigger is a push button.

The apparatus may be constructed with a safety that is movable between a safe position and a fire position. In the safe position, the safety covers access to the trigger. In the fire position, the safety allows access to the trigger.

Depending on the exigencies of a particular application, the apparatus may include a light source adapted to illuminate an area extending away from the front portion. For example, the light source may be constructed from at least one light emitting diode. In other examples, the apparatus may have a light switch operable to cause the light source to illuminate, such that the light switch is disposed on the grip portion where a user can actuate the light switch using a hand that is grasping the grip portion. In some cases, the light switch may be a slide switch. In such embodiments, the light switch may be movable along an axis that is approximately parallel to the barrel axis. Typically, the light switch is proximate to a trigger such that a user can actuate the light switch and the trigger using a hand that is grasping the grip. In some embodiments, the apparatus may also include an aiming mechanism, such as a laser pointer, integrally formed in the front portion.

According to another aspect, the invention provides an apparatus for firing a non-lethal projectile comprising a body with a grip portion and a front portion, in which the body defines an internal cavity. A light source may be disposed in the cavity to illuminate an area outside the body. A firing mechanism may also be provided to cause a projectile to be propelled through the front portion.

In some exemplary embodiments, the front portion includes a transverse front face through which the projectile exits and light is projected. The apparatus may be constructed with a light switch integrally formed on the body. In some such embodiments, the light switch may be proximate to the grip portion such that a user can actuate the light switch using a hand that is grasping the grip portion.

In other examples, the apparatus may include an aiming mechanism disposed in the cavity. For example, the aiming mechanism may project a laser beam through the front face. Embodiments are also contemplated in which the body is generally cylindrical in shape.

According to a further aspect, the invention provides an apparatus for firing a frangible projectile. The apparatus includes a body shaped to resemble a flash light. A light source is disposed in a cavity in the body, such that the light source is adapted to project light out of the body. A firing mechanism may also be provided to cause a frangible projectile to be propelled out of the body.

In some examples, a light switch and a trigger may be provided. In such embodiments, the light switch may be movable with respect to the body with a thumb while holding the body. The trigger may be also movable with respect to the body with an index finger while holding the body.

A still further aspect of the present invention is achieved by a flash light with a generally cylindrical body. The flash light includes a light source disposed in the body, such that the light source is operable to project light out of the body. A firing mechanism may also be provided to cause a non-lethal projectile to be propelled out of the body.

In some exemplary embodiments, the flash light may include a valve arrangement disposed in the body. For example, the valve arrangement may selectively open and close fluid communication between a source of compressed gas and the firing mechanism. In some cases, the flash light may include a canister of compressed gas disposed in the body that is in fluid communication with the firing mechanism. The flash light may be constructed with a magazine disposed in the body.

In other examples, the flash light may include a safety associated with the firing mechanism, such that the safety moves along an axis that is approximately parallel with a longitudinal axis of the body. The body may include a bulge to which the safety is slidably coupled. In some cases, the safety may have an arcuate shape.

According to another aspect, the invention provides an apparatus for firing a non-lethal projectile, the apparatus having a barrel, firing mechanism and inlet valve. The firing mechanism may include a piston disposed in a chamber, such that the piston is movable between a first position that prevents fluid communication and a second position that allows fluid communication. The inlet valve is movable between an open position that provides fluid communication between the chamber and a source of compressed gas and a closed position that prevents fluid communication between the chamber and the source of compressed gas. The inlet valve moves to the closed position responsive to movement of the piston from the first position to the second position.

In some exemplary embodiments, the piston is configured to move from the first position to the second position when a pressure within the chamber exceeds a predetermined pressure. For example, a spring may urge the piston toward the first position when the chamber reaches the predetermined pressure. Depending on the application, the inlet valve may be a Schrader valve.

Another aspect of the present invention is achieved by a valve arrangement that includes a body, a first valve and a second valve. The body defines a passageway between an inlet port and an outlet port. The first valve may move between a first position that allows fluid communication between the inlet port and the outlet port and a second position that prevents fluid communication between the inlet port and the outlet port. When the pressure within the passageway exceeds a predetermined pressure, the first valve moves to the first position. Likewise, the first valve moves to the second position when the pressure within the passageway is less than the predetermined pressure.

According to another aspect, the invention provides a method of propelling a non-lethal projectile. An inlet valve in fluid communication between a supply of compressed gas and a chamber is provided. The inlet valve is opened responsive to actuation of a trigger. The flow of the compressed gas is prevented from exiting the chamber until a pressure within the chamber reaches a predetermined pressure. When the pressure within the chamber reaches the predetermined pressure, the compressed gas is allowed to escape the chamber to propel a projectile.

Additional features and advantages of the invention will become apparent to those skilled in the art upon consideration of the following detailed descriptions exemplifying the best mode of carrying out the invention as presently perceived.

BRIEF DESCRIPTION OF DRAWINGS

The present disclosure will be described hereafter with reference to the attached drawings which are given as non-limiting examples only, in which.

Figure 1:
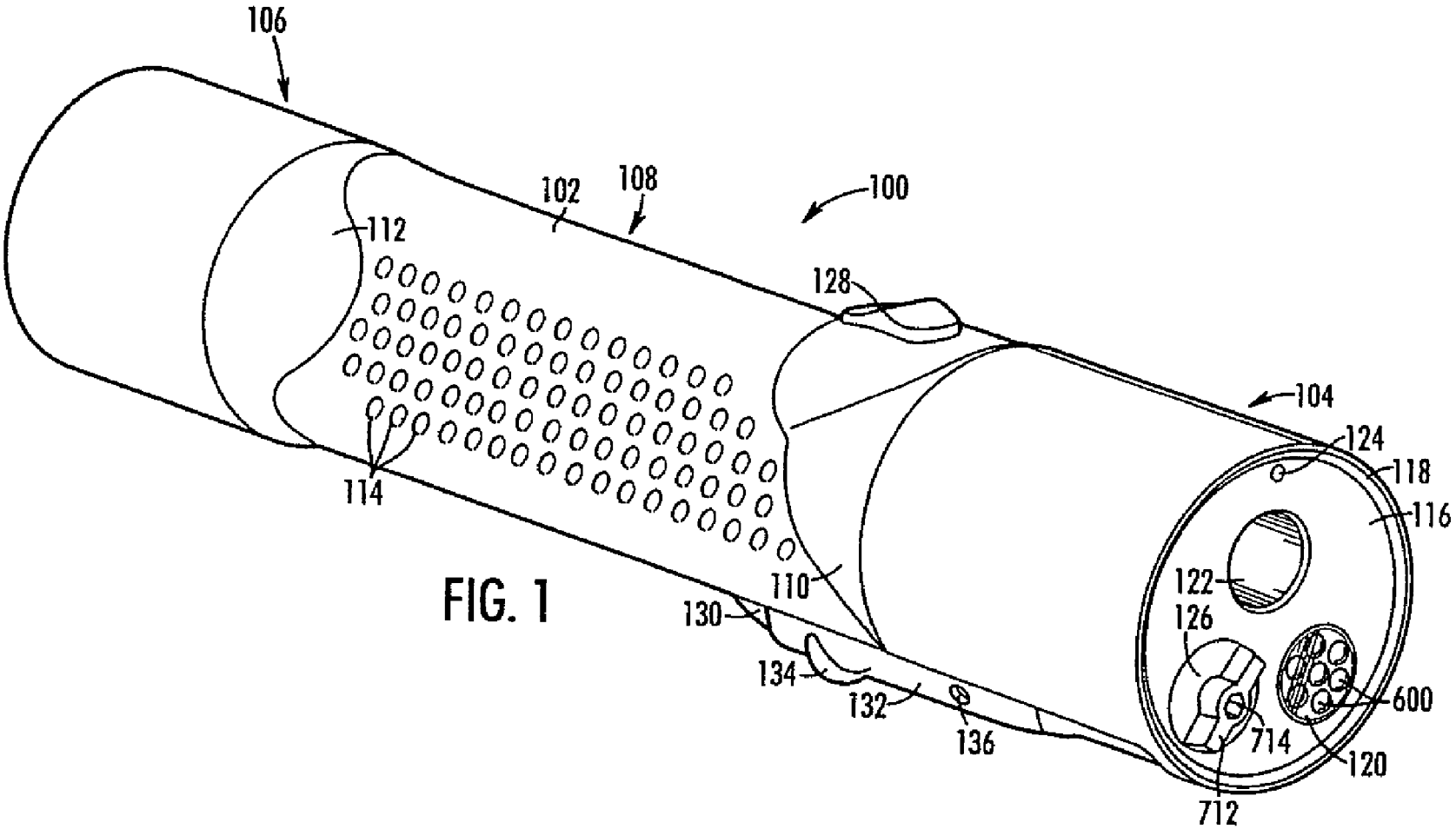
FIG. 1 is a right side perspective view of an example device in accordance with one aspect of the present invention.

Corresponding reference characters indicate corresponding parts throughout the several views. The components in the Figures are not necessarily to scale, emphasis instead being placed upon illustrating the principles of the invention. The exemplification set out herein illustrates embodiments of the invention, and such exemplification is not to be construed as limiting the scope of the invention in any manner.

DISCLOSURE OF THE ILLUSTRATIVE EMBODIMENT

The present disclosure will be described hereafter with reference to the attached drawings which are given as non-limiting examples only, in which:

According to one aspect, the present invention provides a flash light with a projectile-launching mechanism. By the term "flash light," it is meant a portable device with a light source that may be selectively turned on/off to project a beam of light from the device. The light source continuously radiates light when turned on by the user, instead of a brief flash of light, such as that emitted from a photographic lamp.

In the example shown in FIG. 1, the flash light 100 has a body 102. The shape of the body 102 shown in the figures is for example purposes only. Although the body preferably resembles the shape of a typical flash light, it should be appreciated that flash lights come in many different shapes and sizes. The body 102 may be formed in any suitable shape or size, whether the body 102 resembles a flash light or not. In this example, the body 102 has a front portion 104 and a rear portion 106. As shown, the front and rear portions 104, 106 are generally cylindrical in shape. The longitudinal axis of the front and rear portions 104, 106 are also along a generally common axis, as shown.

The body 102 may include a grip portion 108 that is disposed between the front portion 104 and the rear portion 106. In the example shown, the grip portion 108 has a generally cylindrical shape. In some embodiments, the grip portion 108 may have an oblong cross-section. This example also shows the grip portion 108 with a smaller diameter than the front portion 104 and the rear portion 108. In such a configuration, the body 102 may include a front sloped portion 110 to smoothly transition between the front portion 104 and the grip portion 108. Likewise, the body 102 may include a rear sloped portion 112 to smoothly transition between the rear portion 106 and the grip portion 108.

It should be appreciated that the invention is not limited to the particular shape of the body 102 shown in FIG. 1, but this is provided for example purposes only. For example, the grip portion 108 may have a similar diameter or a larger diameter than the rear and front portions 104, 106. By way of another example, the body 102 need not necessarily be cylindrical, but could be spherical, conical, box shaped, or other shapes. Although the body 102 is shown as a two-piece construction, it should be appreciated that the body 102 may be formed from a single piece or multiple pieces coupled together. Embodiments are also contemplated in which rear portion 106 may be optional.

In the example shown, the grip portion 108 includes optional surface ornamentation 114. The surface ornamentation 114, in addition to having an aesthetic aspect, tends to provide texture to facilitate grasping the grip portion 108. Instead of the knob pattern shown, the grip portion 108 may have a knurled surface, ridges, dimples or other surface ornamentation.

The front portion 104 may include a transverse front face 116. As shown, the front face 116 is recessed with a peripheral lip 118. The front face 116 defines openings for a light source 120 and a barrel 122 through which projectiles are propelled. Preferably, the projectiles are propelled out the barrel 122 in the same direction in which the light source 120 projects light. In some embodiments, the light source 120 may be optional. The front face 116 may also define a hole for an optional aiming mechanism 124. For example, the aiming mechanism 124 may be a laser. In such configurations, the laser would typically project a laser beam on the surface in which the projectile would impact after firing.

Figure 12:
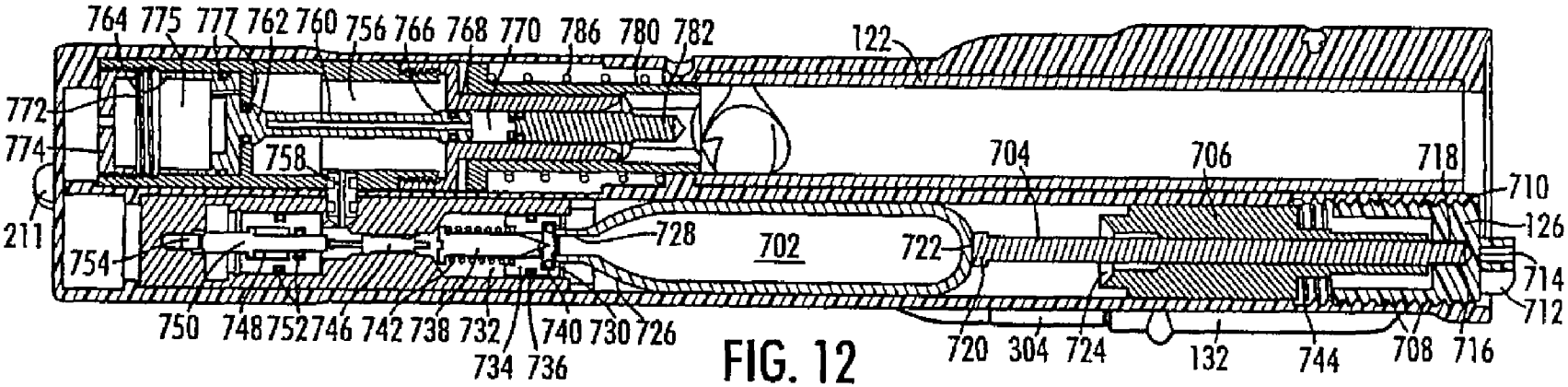
FIG. 12 is a side cross-sectional view of the device of FIG. 1 prior to actuation of the trigger.
Figure 13:
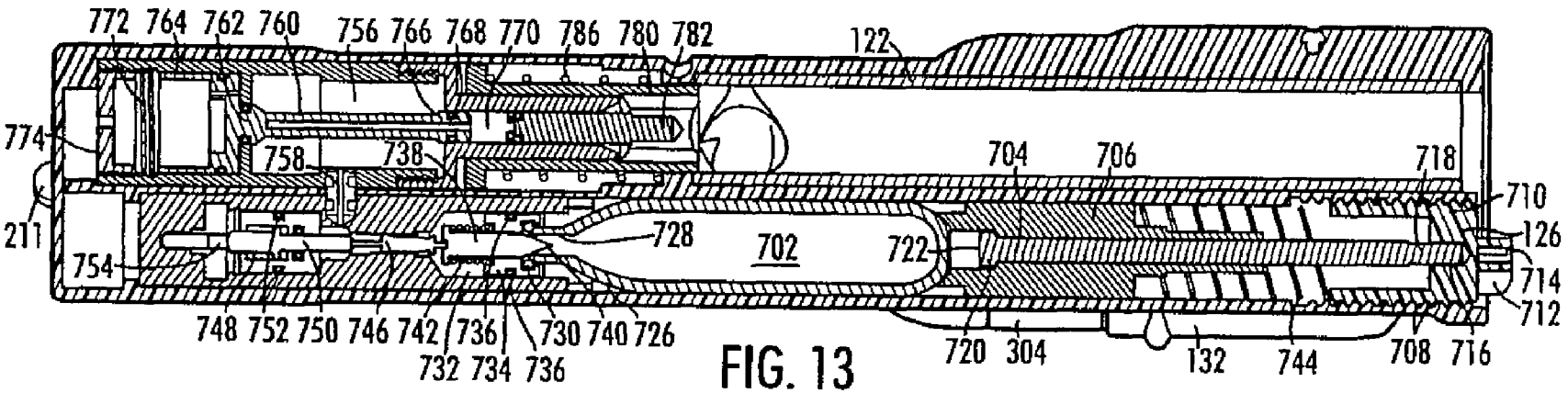
FIG. 13 is a side cross-sectional view of the device of FIG. 1 during actuation of the trigger.

In the example shown, the front face 116 also defines a hole for an end cap 126. The end cap 126 may be opened to allow access to a pressurized canister 702 (see FIGS. 7, 12 and 13) associated with the flash light 100. It should be appreciated that access to the canister 702 may be formed on another part of the body 102, such as the rear, bottom, or top portions of the body 102.

In the example shown, the top of the body 102 includes a switch actuator 128. The switch actuator 128 may be used as a light switch to turn on/off the light source 120 and/or the aiming mechanism 124. As shown, the switch actuator 128 is a slide switch, but the switch actuator 128 could be a push button or other type of switch. By way of another example, the light source 120 and/or aiming mechanism 124 may be turned on/off by a switch that is actuated by twisting the front portion 104 or rear portion 106.

Figure 6:
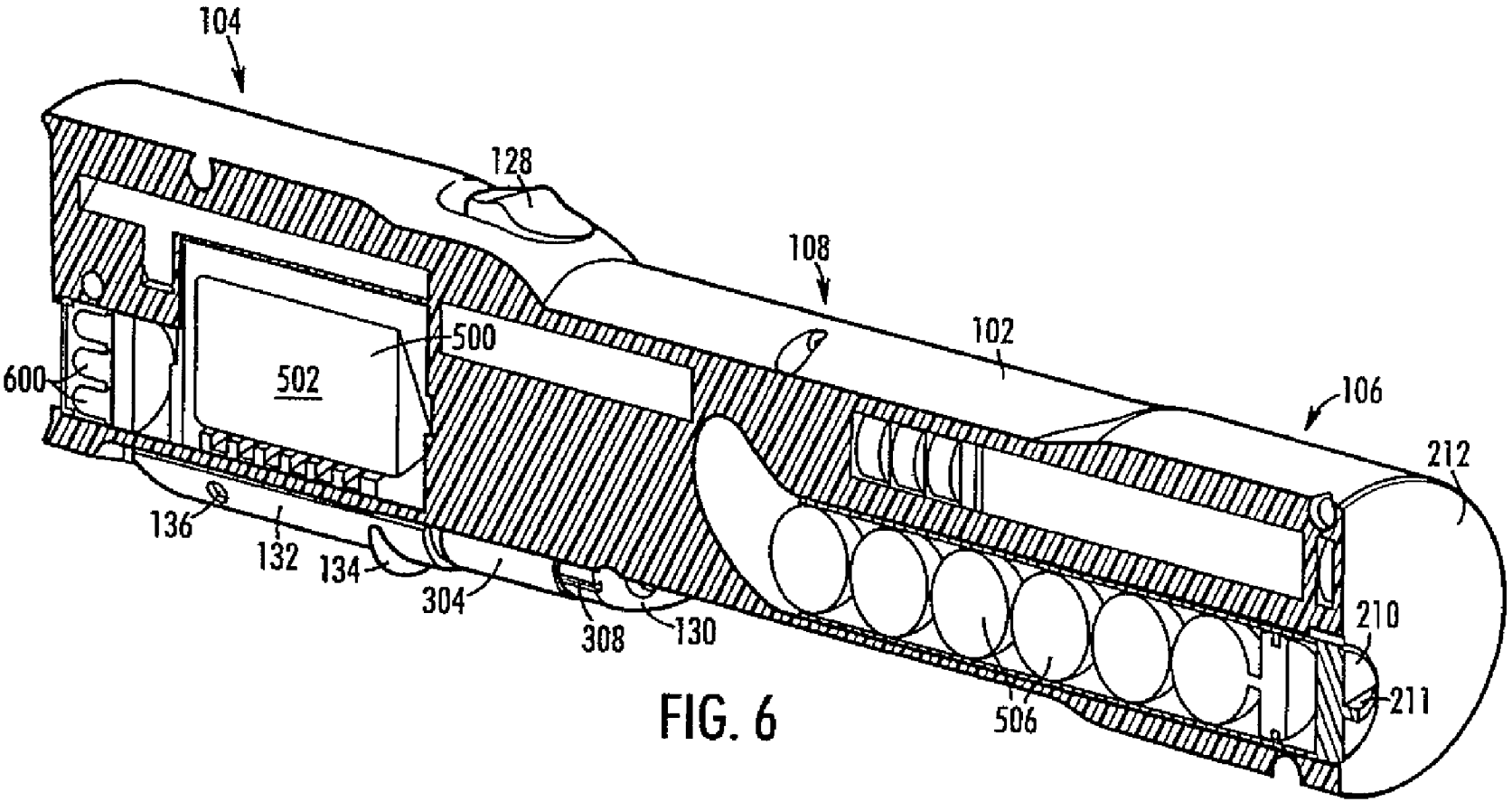
FIG. 6 is a side cross-sectional view of the device of FIG. 5.

In the example shown, a bulge 130 is formed on the bottom portion of the body 102. A trigger 304 is disposed in the bulge 130 but is covered by a safety 132 in FIG. 1. In a safe position, the safety 132 covers the trigger 304 (see. FIG. 6) to prevent accidental firing. The safety 132 is movable to a fire position in which the safety does not prevent access to the trigger 304. In the example shown, the safety 132 includes a finger tab 134 to ease engagement and movement of the safety 132 by the user. An aperture 136 may be formed through the safety 132 and bulge 130. A pin (not shown) may be placed through the aperture 136 to lock the safety 132 in place. In this manner, the pin would need to be removed to move safety 132 to the fire position and thereby provide access to the trigger 304 for firing. It should be appreciated that other safety mechanisms that cover access and/or prevent movement of the trigger may be suitable.

Figure 2:
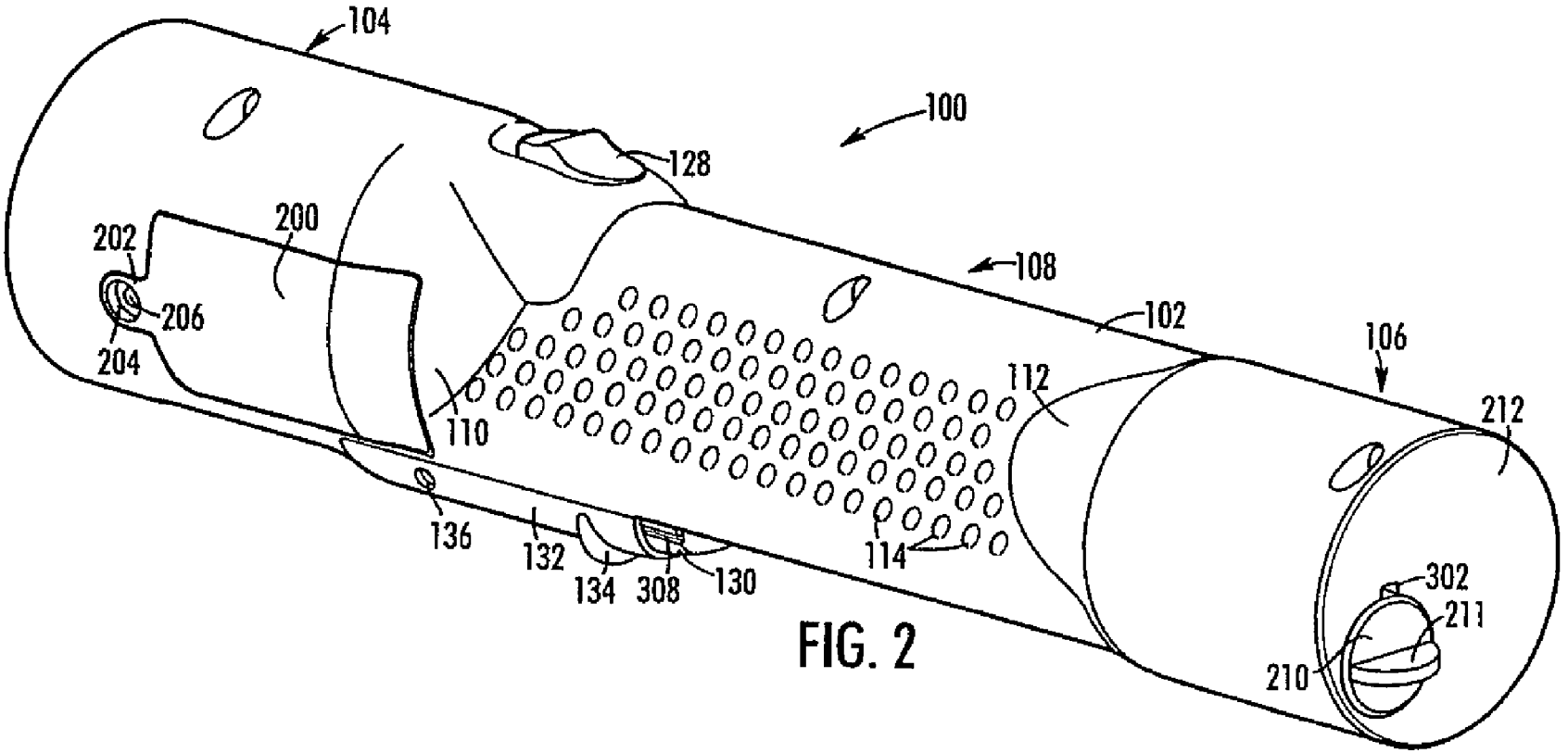
FIG. 2 is a left side perspective view of the device shown in FIG. 1.

FIG. 2 shows a left perspective view of the flash light 100 shown in FIG. 1. The flash light may include an energy source to electrically power the light source 120 and/or the aiming mechanism 124. It is anticipated that the energy source may be used for other components of the flash light 100. For example, the energy source may be used to load and/or fire the projectiles, depending on the particular application. In this example, the flash light 100 includes a battery door 200 that closes a cavity to house the energy source, such as a battery (see FIGS. 5 and 6). In the example shown, the battery door 200 includes an extension 202 with a hole 204 through which a fastener (not shown) may engage a threaded bore 206 to secure the battery door 200 to the body 102. Embodiments are contemplated in which the battery door 200 is optional. For example, a rechargeable energy source, such as a rechargeable battery or solar panel, may be formed integral to or disposed in the body 102. For example, the flash light 100 may include a port (not shown) for recharging the energy source. By way of another example, the energy source may be recharged wirelessly, such as by using an electromagnetic signal.

Figure 5:
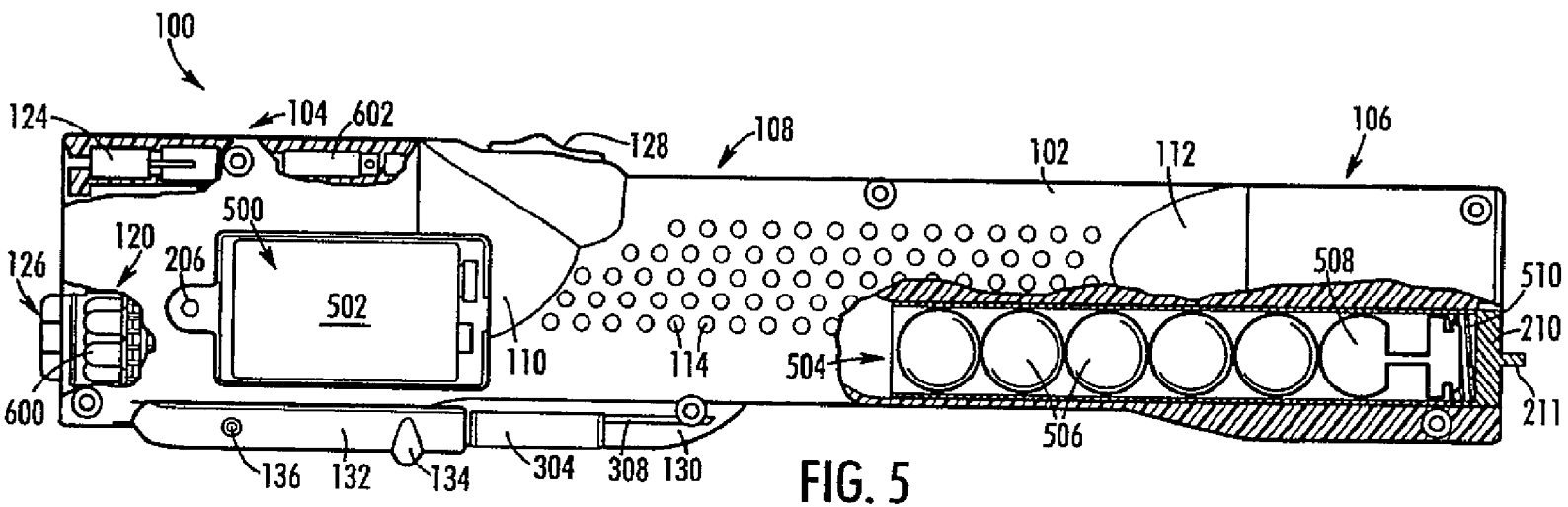
FIG. 5 is a left side view of the device of FIG. 1 with the safety in the fire position and with partial cutaway section to reveal internal components.

The flash light 100 may include a magazine 210 to hold a plurality of projectiles (see FIGS. 5 and 6). In the example shown, the magazine 210 may be accessed on the rear face 212 of the body 102. As shown, the end of the magazine 210 includes a ridge 211 that a user may twist to remove the magazine 210. Embodiments are contemplated other than the internal magazine 210 shown. For example, the flash light 100 may include a port to feed projectiles from an external magazine or hopper.

Figure 3:
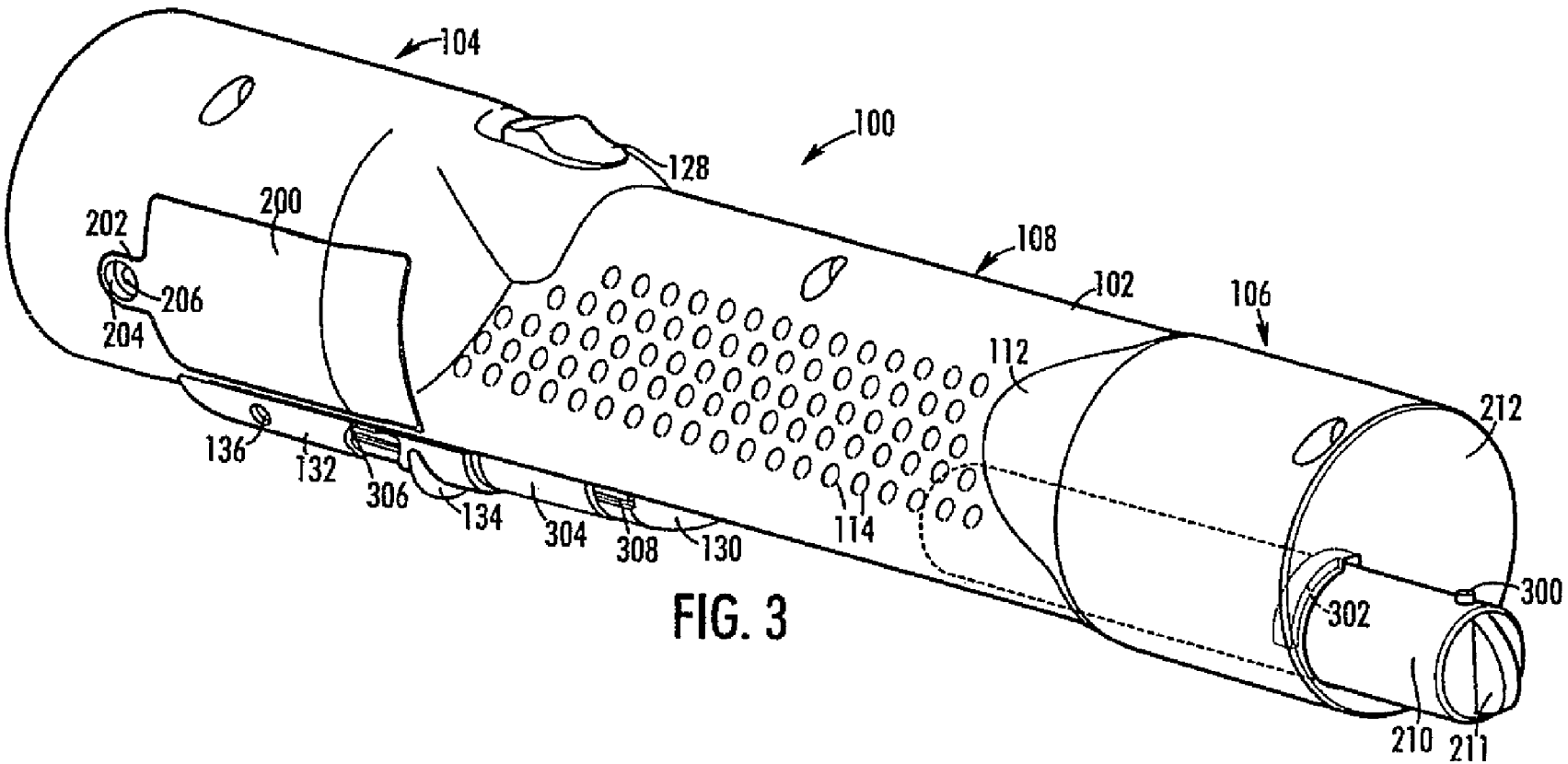
FIG. 3 is the view of FIG. 2, with the magazine partially inserted and the safety having a partially cutaway.

Referring to FIG. 3, the magazine 210 is partially inserted into a channel formed in the body 102 of the flash light 100. In the example shown, the magazine 210 includes a detent 300 that engages a slot 302 to lock magazine with an interference fit. The detent 300 is dimensioned to be received by the slot 302 such that engaging and twisting the magazine with respect to the slot 302 locks the magazine 210 to the body 102. It should be appreciated that other locking mechanisms may be suitable to detachably lock the magazine 210 with respect to the body 102. Embodiments are also contemplated in which the magazine 210 is loaded into another portion of the body, such as the front, top, or bottom.

Also visible in FIG. 3 is the trigger 304. In the example shown, the trigger 304 is a push button that is actuated about an axis that is generally perpendicular to the longitudinal axis of the body 102. The safety 132 may be moved rearwardly to a safe position and thereby prevent access to the trigger (see FIGS. 1, 2 and 4). The safety 132 may include internal ridges 306 that ride on a track 308 formed on the bulge 130. In this manner, the safety 132 may slide forward to provide access to the trigger 304, or may move rearwardly (FIGS. 1, 2 and 4) to prevent access to the trigger 304. Although the safety 132 is arcuate in shape in the example shown, other shapes may also be suitable. As described previously, a pin (not shown) may be passed through the aperture 136 to lock the safety 132 in the safe or fire position.

Figure 4:
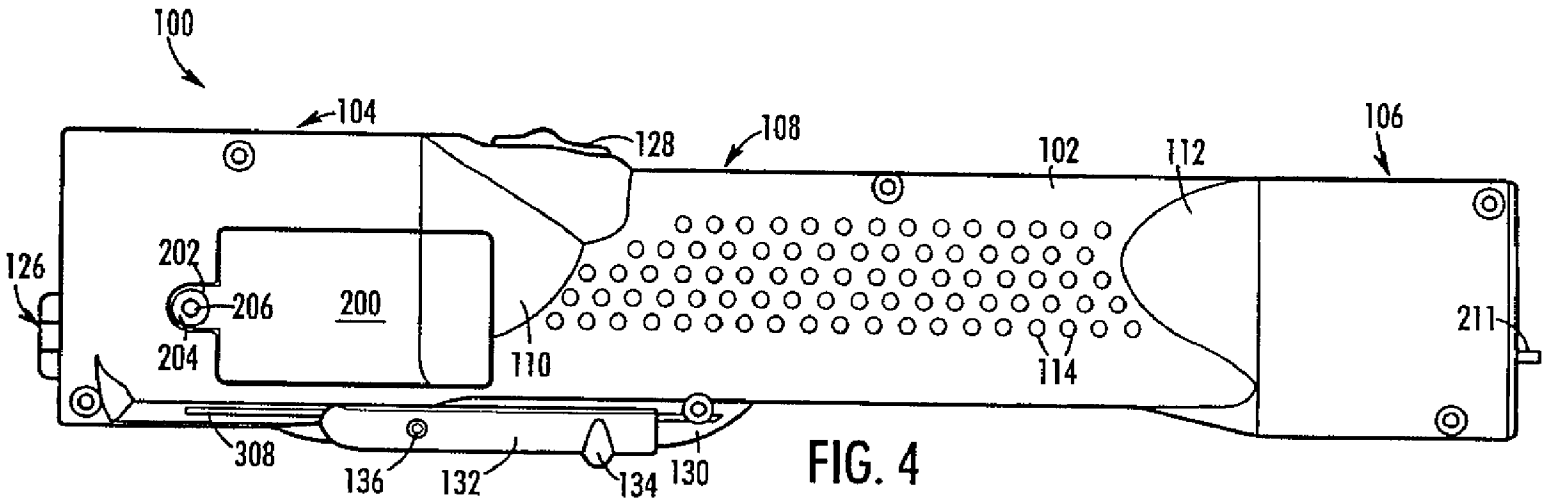
FIG. 4 is a left side view of the device of FIG. 1 with the safety in the safe position.

The movement of the safety 132 is illustrated in FIGS. 4, 5 and 6. In FIG. 4, the safety 132 is in a safe position, which prevents access to the trigger 304. In FIGS. 5 and 6, the safety 132 is slid forward to the fire position, thereby revealing and providing access to the trigger 304.

Also visible in FIGS. 5 and 6 is the energy source 500. Although a battery 502 is shown in FIG. 5 as the example energy source, it should be appreciated that various types of devices for storing electrical energy could be used, as discussed previously.

FIG. 5 includes a partial cutaway of the rear portion 106 of the body 102 to reveal the internal components of the magazine 210. In the example shown, the magazine includes an open end 504 through which projectiles 506 feed into the firing mechanism (not shown in FIG. 5). A pusher 508 is positioned within the magazine 210 behind the last projectile to be fed into the firing mechanism. In conjunction with a spring 510, the pusher 508 urges the projectiles 506 toward the firing mechanism. The magazine 210 shown herein is provided for purposes of example only. Other magazines, including mechanical and electrical actuators, are also contemplated to feed the projectiles 506 into the firing chamber.

FIGS. 5 and 6 show a side view of an example light source 120. In this example, the light source 120 includes a plurality of LEDs 600. In other examples, the light source may be one or more incandescent lamps, high intensity lamps, xenon lamps, halogen lamps or krypton lamps. The switch actuator 128 works in conjunction with a switch 602 to turn on/off the light source 120 and/or the aiming mechanism 124. In the example shown, the switch 602 has three positions. In a first position, both the light source 120 and the aiming mechanism 124 are off. In a second position, the switch 602 turns on the light source 120, but not the aiming mechanism 124. In a third position, both the light source 120 and the aiming mechanism 124 are turned on. It should be appreciated that the aiming mechanism 124 may be independently turned on/off using the switch 602 and/or another switch (not shown) associated with the flash light 100.

Figure 7:
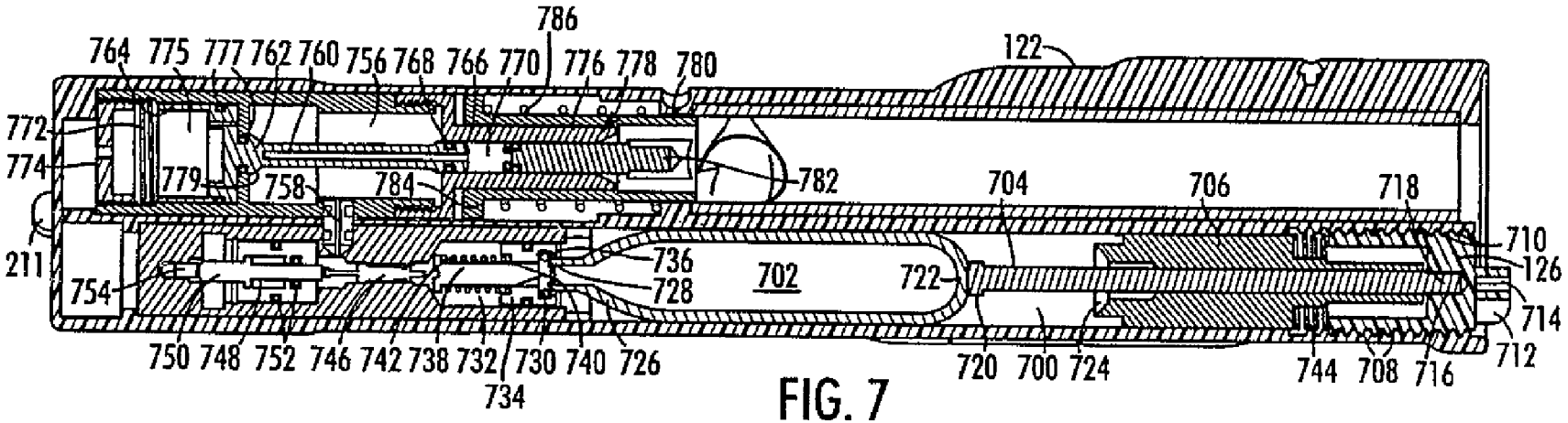
FIG. 7 is a side cross-sectional view of the device of FIG. 1.

FIG. 7 is a cross-sectional view of the flash light 100 to reveal elements of a valve arrangement and firing mechanism. The flash light 100 includes a channel 700 in which a canister with compressed gas 702, a rod 704, a ram 706 and the end cap 126 are disposed. As previously discussed, the end cap 126 may be removed to provide access to the canister 702. In the example shown, the end cap has external threads 708 that threadably engage internal threads 710 formed on the channel 700. The user may unscrew the end cap using wings 712. Alternatively, the user may unscrew the end cap 126 by engaging the keyed bore 714 using a tool, such as a hex wrench. With the end cap 126 unscrewed, the rod 704 and ram 706 may be removed from the channel 700 to provide access to the canister 702. This allows the canister 702 to be removed for refilling and/or replacement by another canister. It should be appreciated that the end cap may be connected to the body 102 through means other than threadable engagement. For example, an interference fit, frictional fit, or other connection may be suitable.

In the example shown, the end cap includes an internal bore 716 that receives a tip 718 of the rod 704. The opposing end of the rod includes an engaging portion 720 that contacts an end 722 of the canister 702.

The ram 706 is slidably disposed in the channel 700. The ram 706 includes a hole dimensioned to receive the rod 704. As described below, the ram 706 may ride on the rod 704 between a first position shown in FIG. 7 and a second position shown in FIG. 13. The ram 706 may include a cavity 724 that has a complementary shape to receive the end 722 of the canister 702 when the ram 706 is in the position shown in FIG. 13.

The canister 702 may hold a volume of compressed gas, such as carbon dioxide or nitrogen. In the example shown, the canister 702 has a sloped neck 726 that terminates in a mouth 728. Typically, the mouth 728 is initially covered with a seal, such as a foil, to prevent escape of compressed gas from the canister 702. As shown, the mouth 728 abuts a seal 730 to prevent escape of gas into the channel 700. Instead of the arrangement shown in FIG. 7, the channel 700 may be configured to hold a volume of compressed gas. In such a configuration, the body 102 may include a port to fill the channel 700 with compressed gas. In such a configuration, the canister 702, rod 704, ram 706 and end cap 126 may be optional.

Figure 10:
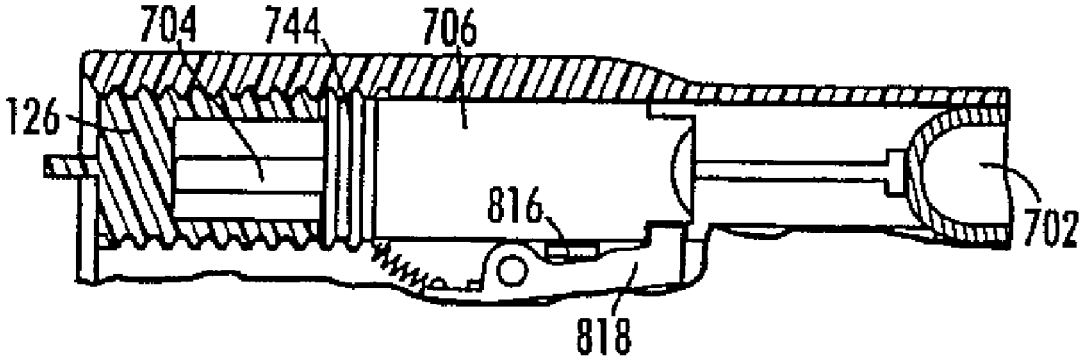
FIG. 10 is a side cross-sectional view of the device of FIG. 1 showing the ram held by a sear.

A reserve chamber 732 is adjacent to the mouth 728 of the canister 702. A wall 734 is disposed between the reserve chamber 732 and the channel 700. The wall 734 includes grooves for a seal 736 to prevent escape of gas from the reserve chamber 732 to the channel 700. The wall 734 is slidably disposed to allow movement of the mouth 728 towards a piercing pin 738. The piercing pin includes a tip 740 that is sufficiently sharp to pierce the seal initially covering the mouth 728 of the canister 702, thereby releasing compressed gas into the reserve chamber 732. A spring 742 urges the wall 734 toward the canister, thereby retaining the canister 702 between the wall 734 and the engaging portion 720 of the rod 704. As discussed below, the ram is urged by a spring 744 toward the canister 702. When released by a sear 818 (see FIGS. 10 and 11), the spring 744 moves the ram 706 to impact the end 722 of the canister 702. This moves the canister 702 and wall 734 so that the tip 740 of the piercing pin 738 pierces the foil covering the mouth 728 of the canister 702 (see FIG. 13).

An inlet valve 746 is positioned between the reserve chamber 732 and a first chamber 748. In the example shown, the inlet valve 746 is a Schrader valve; however, other suitable valves may be used to selectively open/close fluid communication between the reserve chamber 732 and the first chamber 748. A valve engaging pin 750 has an end capable of engaging the inlet valve 746. When the valve engaging pin 750 engages the valve 746, this causes the inlet valve 746 to open (see FIG. 12), thereby allowing fluid communication between the first chamber 748 and the reserve chamber 732. When the valve engaging pin 750 does not engage the inlet valve 746, no flow is allowed between the reserve chamber 732 and the first chamber 748 (see also FIG. 11). In some embodiments, the valve engaging pin 750 may include a groove that allows fluid communication between the first chamber 748 and the atmosphere when the valve engaging pin does not engage the inlet valve 746. This allows the first chamber 448 to be safely vented to the atmosphere in the event that inlet valve 746 develops a leak. The groove could be positioned on the valve engaging pin 750 such that fluid communication with the atmosphere is only allowed when the valve engaging pin 750 does not engage the inlet valve 746. In this manner, there would not be a loss of pressure within the first chamber 748 when the valve engaging pin 750 engages the inlet valve 746. Seals 752 are provided between the first chamber 748 and the valve engaging pin 750 to prevent escape of gas out of the first chamber 748. A lever 754 moves the valve engaging pin 750 between a position in which the valve engaging pin 750 engages the inlet valve 746 and a position in which the valve engaging pin 750 does not engage the inlet valve 746. Actuation of the lever 754 will be described below.

The first chamber 748 is in fluid communication with a second chamber 756 through a passage 758. A stem 760 of a piston 762 is disposed within the second chamber 756. The piston 762 includes a leading end 764 and a tip 766. The tip 766 includes a groove for a seal 768 to provide sealing contact between the second chamber 756 and a third chamber 770. A spring 772 is disposed between the leading end 764 of the piston 762 and a stop 774. As described below, if the pressure within the second chamber 756 rises to a predetermined level, the pressure differential between the second chamber 756 and a fourth chamber 775 will overcome the force of the spring 772 to move the piston 762. This movement causes the tip 766 to move out of sealing engagement between the second chamber 756 and the third chamber 770. Movement of the piston 762 is limited by the engagement of leading edge 764 with the stop 774. The piston 762 may include grooves for seals 777 to prevent fluid communication between the second chamber 756 and the fourth chamber 775.

The tip 766 of the piston 762 is disposed within a bore formed in a funnel 776. A bolt 778 includes an outer portion 780 that surrounds the funnel 776 and an inner portion 782 disposed within the funnel 776. The outer portion 780 of the bolt 778 includes a flange 784 that engages a spring 786 to urge the bolt 778 into the position shown in FIG. 7. However, when the piston 762 moves out of sealing engagement between the second chamber 756 and third chamber 770, the pressure within the third chamber 770 overcomes the force of the spring 786 to move the bolt 778 to the position shown in FIG. 15. This action pushes the projectile 506 into the barrel 122 and the flow of gas propels the projectile 506 out of the barrel 122.

Figure 8:
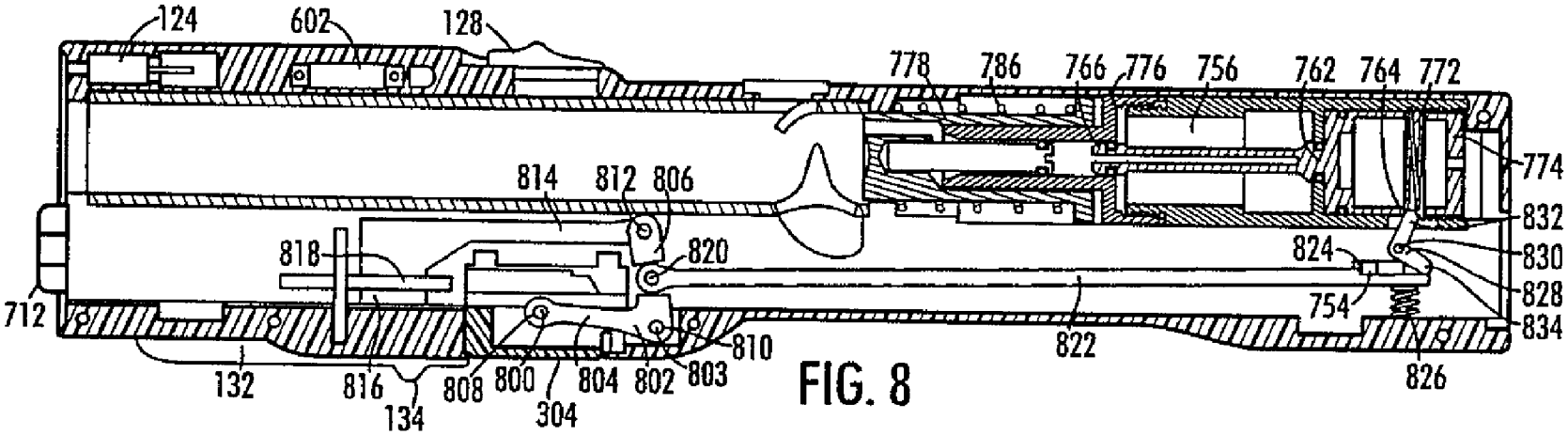
FIG. 8 is a side cross-sectional view of the device of FIG. 1 prior to actuating the trigger.

Referring now to FIG. 8, this is a cross-sectional view of the flash light 100 to show, among other components, the trigger assembly. The trigger 304 includes a trigger pivot pin 800 that couples a trigger actuator 802 to the trigger 304. The trigger actuator 802 has a first leg 804 and a second leg 806. The first leg 806 has an end with a hole that is dimensioned to receive the trigger pivot pin 800. The other end of the first leg 804 has a hole 810 to receive a pin 803. The second leg 806 includes a first pivot 812 that is pivotably connected to an end of a sear engager 814. The sear engager 814 includes a sear engaging portion 816 configured to disengage a sear 818 from the ram 706 (see FIGS. 10-11).

The second leg 806 also includes a second pivot 820 coupled to an elongated link 822. The link 822 includes an opposing end with a ledge 824 that engages the lever 754. Movement of the link 822 to the position of FIG. 9 pushes the lever 754, which opens the inlet valve 746. A return spring 826 urges the link 822 against the lever 754.

A cam 828 is pivotably disposed on a pivot pin 830. The cam 828 has a piston engaging end 832 adjacent to the leading end 764 of the piston 762. When the piston 762 moves out of sealing engagement between the second chamber 756 and a third chamber 770, the leading end 764 rotates cam 828 about the pivot pin 830, as described with respect to FIG. 16. The cam 828 also includes link engaging end 834 that moves the link 822 out of engagement with the lever 754, when the cam 828 pivots due to movement of the piston 762.

Figure 9:
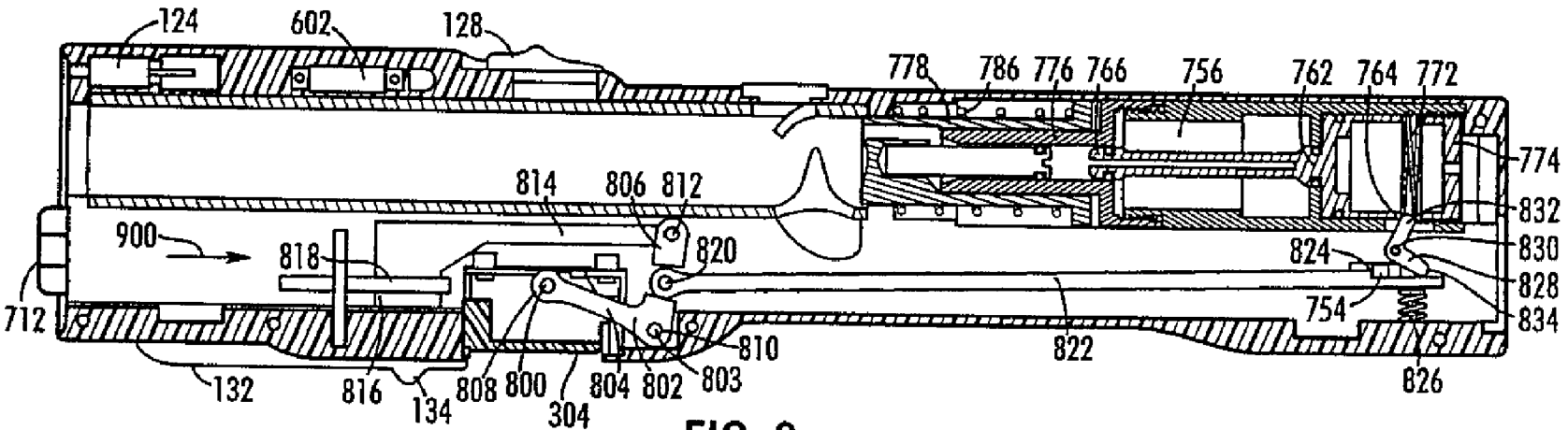
FIG. 9 is a side cross-sectional view of the device of FIG. 1 during actuation of the trigger.
Figure 11:
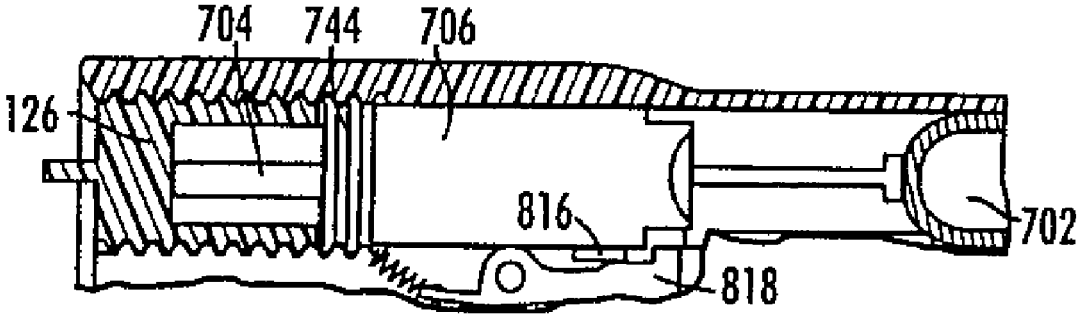
FIG. 11 is a side cross-sectional view of the device of FIG. 10 showing release of the ram by the sear.

FIGS. 8-13 show the piercing of the canister 702 to release compressed gas into the reserve chamber 732. This typically occurs the first time the trigger 304 is actuated after loading of the canister 702. As best seen in FIG. 9, actuation of the trigger moves trigger actuator 802 to pivot about pin 803. The pivoting of trigger actuator 802 moves both the sear engager 814 and the link 822 in the direction of arrow 900. This causes the sear engaging portion 816 of the sear engager 814 to disengage the sear 818 from the ram 706 (as best seen in FIG. 11). With the ram 706 released from the sear 818, the spring 744 drives the ram 706 into the end 722 of the canister 702. This impact moves the canister 702 to a position where the mouth 728 engages the tip 766 of the piercing pin 738 (see FIG. 13). Since the mouth 728 is surrounded by the seal 730, the movement of the canister 702 moves the spring loaded wall 734. When the canister 702 is punctured by the piercing pin 738, compressed gas is released into the reserve chamber 732. Due to the spring loaded wall 734, the canister 702 will remain secured between the wall 734 and the engaging portion 720 of the rod 704. The pressure of the canister 702 within the reserve chamber 732 may apply force to the spring loaded wall 734 to further urge the spring loaded wall 734 into engagement with the canister 734.

Movement of the link 822 in the direction of arrow 900 causes movement of the lever 754. The movement of the lever can be best seen in FIGS. 12 and 13. The movement of the lever 754 pushes the valve-engaging pin 750 into engagement with the inlet valve 746. This opens the inlet valve 746 so that compressed gas in the reserve chamber 732 flows into the first chamber 748. The gas also flows into the second chamber 756 via the passage 758. The pressure in the second chamber 756 continues to build until the pressure differential between the second chamber 756 and the fourth chamber 775 is sufficiently great to overcome the force of the spring 772. The amount of pressure required to overcome the force of the spring depends on the spring force of the spring 772 and the amount of exposed surface area 779 of the piston 762. The spring force of the spring 772 and the piston 762 may be designed so that the tip 766 moves out of sealing engagement at a predetermined pressure. This means that this arrangement regulates the pressure within the second chamber 756. Accordingly, a regulator often associated with a pressurized canister may not be necessary. Additionally, the pressure with which the projectile 506 is propelled can be controlled to be the same for each shot until the pressure in the reserve chamber 732 is less than the predetermined pressure.

Figure 14:
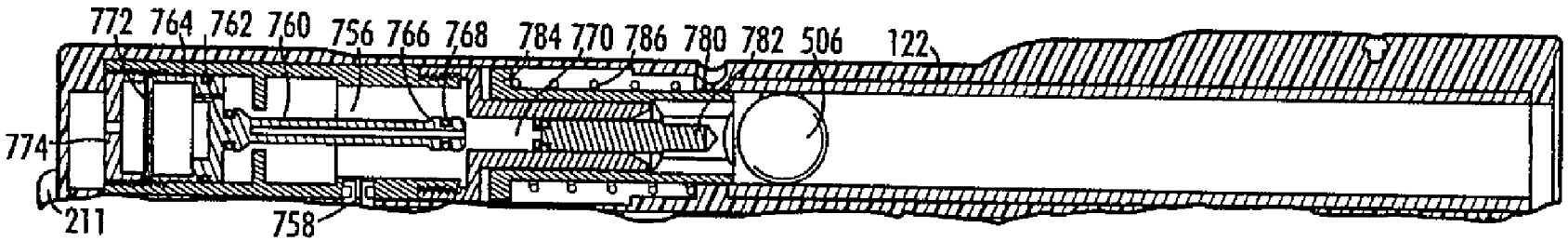
FIG. 14 is an enlarged cross-sectional view of the device of FIG. 1 showing movement of the piston.
Figure 15:
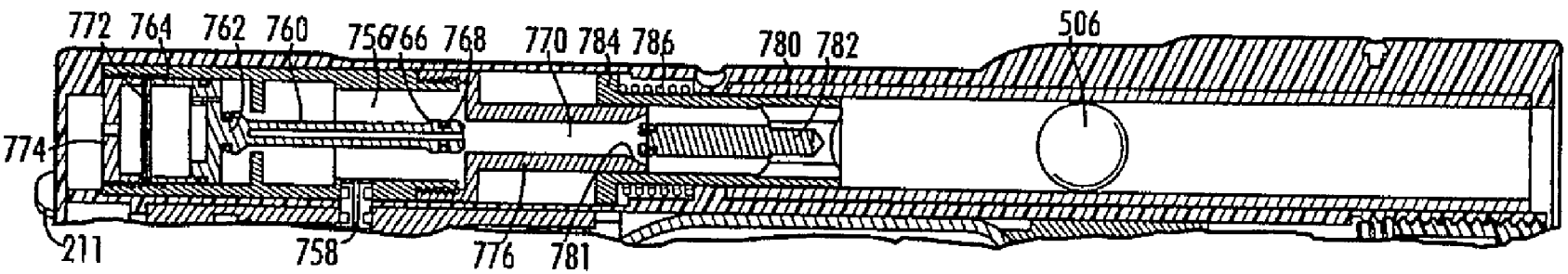
FIG. 15 is an enlarged partial cross-sectional view of the device of FIG. 1 showing the projectile being propelled from the barrel.

When the pressure is sufficient within the second chamber 756 to move the piston 762 out of sealing engagement between the second chamber 756 and the third chamber 770, the gas flows into the third chamber 770, as shown in FIG. 14. The pressure of the gas in the third chamber 770 moves the bolt 778 until the inner portion 782 clears a chamfered portion 781 of the funnel 776. When the inner portion 782 of the bolt 778 moves passed the chamfered portion 781 of the funnel 776, the inner portion 782 no longer seals the third chamber 770 from the barrel 122. Accordingly, the pressure of the compressed gas propels the projectile 506 out of the barrel, as seen in FIG. 15.

After the projectile 506 is propelled through the barrel 122, the pressure within the second chamber 756 drops such that the pressure differential between the second chamber 756 and the fourth chamber 775 equalizes. This allows the spring 772 to urge the tip 766 of the piston 762 back into sealing engagement between the second chamber 756 and the third chamber 770.

Figure 16:
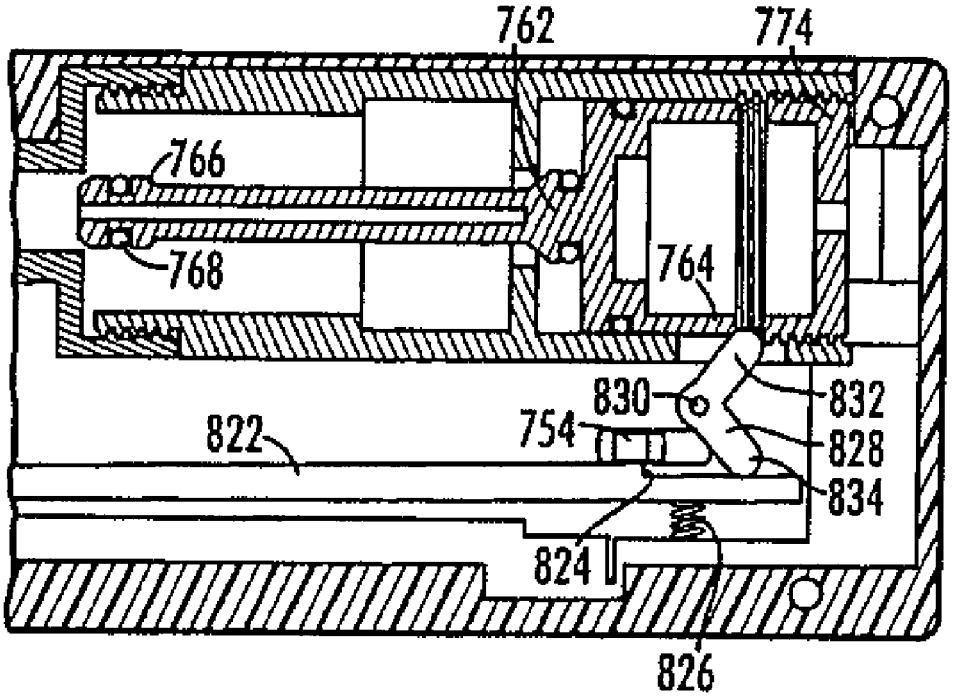
FIG. 16 is an enlarged partial cross-sectional view of the device of FIG. 1 showing engagement of the cam by the piston.

Referring now to FIG. 16, when the piston 762 moves out of sealing engagement, the leading end 764 pivots the cam 828 about the pivot pin 830. This causes the link engaging end 834 of the cam 828 to disengage the ledge 824 of the link 822 from the lever 754. This disengages the lever 754 from the valve engaging pin 750, which shuts off the inlet valve 746. When the trigger 304 is released, the return spring 826 urges the link 822 into engagement with the lever 754.

It should be appreciated that the valve arrangement and trigger mechanism are suitable for use in any compressed gas gun, regardless of the particular shape or configuration of the body. Accordingly, the valve arrangement and trigger mechanism could be employed in a device other than a flash light or a flash light-like device. For example, the valve arrangement may be suitable for any paintball gun.

Corresponding reference characters indicate corresponding parts throughout the several views. The exemplification set out herein illustrates an embodiment of the invention, in one form, and such exemplification is not to be construed as limiting the scope of the invention in any manner.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An apparatus for firing a non-lethal projectile, said apparatus comprising:

a barrel;

a firing mechanism including a piston disposed in a chamber, wherein said piston is movable between a first position and a second position, and wherein said piston prevents fluid communication between said chamber and said barrel in said first position and said piston allows fluid communication between said chamber and said barrel in said second position;

an inlet valve movable between an open position that provides fluid communication between said chamber and a source of compressed gas and a closed position that prevents fluid communication between said chamber and the source of compressed gas;

a cam operatively connected between said piston and said inlet valve, wherein said piston engages said cam to close said inlet valve when said piston moves from said first position to said second position; and wherein said inlet valve moves to said closed position responsive to movement of said piston from said first position to said second position.

2. The apparatus of claim 1, wherein said piston is configured to move from said first position to said second position when a pressure within said chamber exceeds a predetermined pressure.

3. The apparatus of claim 1, further comprising a spring urging said piston toward said first position.

4. The apparatus of claim 3, wherein said spring has a spring force selected to maintain said piston in said first position until a pressure within said chamber reaches a predetermined pressure.

5. The apparatus of claim 1, wherein said inlet valve is a Schrader valve.

6. The apparatus of claim 1, further comprising a lever operatively connected between said cam and said inlet valve, wherein said lever moves in a first direction responsive to movement of said cam, and wherein said inlet valve moves to said closed position responsive to said lever moving in said first direction.

7. The apparatus of claim 6, wherein movement of said lever in a second direction causes said inlet valve to move to said open position.

8. The apparatus of claim 7, further comprising a trigger operatively connected to a link, wherein said link moves said lever in said second direction responsive to actuation of said trigger.

9. The apparatus of claim 6, further comprising a pin operatively connected between said lever and said inlet valve, wherein said pin moves in a third direction responsive to movement of said lever in said first direction, and wherein said inlet valve moves to said closed position responsive to said pin moving in said third direction.

* * * * *